US007140444B2

(12) United States Patent
Mackay

(10) Patent No.: US 7,140,444 B2
(45) Date of Patent: Nov. 28, 2006

(54) DOWNHOLE CUTTING TOOL AND METHOD

(75) Inventor: Alexander Craig Mackay, Scotland (GB)

(73) Assignee: Weatherford/Lamb, Inc, Houston, TX (US)

( * ) Notice: Subject to any disclaimer, the term of this patent is extended or adjusted under 35 U.S.C. 154(b) by 271 days.

(21) Appl. No.: 10/744,852

(22) Filed: Dec. 23, 2003

(65) Prior Publication Data

US 2004/0134668 A1 Jul. 15, 2004

(30) Foreign Application Priority Data

Dec. 27, 2002 (GB) ..... 0230189.3

(51) Int. Cl.
*E21B 19/16* (2006.01)

(52) U.S. Cl. ..... 166/380; 166/207

(58) Field of Classification Search ..... 166/207, 166/380

See application file for complete search history.

(56) References Cited

U.S. PATENT DOCUMENTS

| | | | | |
|---|---|---|---|---|
| 6,070,671 | A | 6/2000 | Cumming et al. | |
| 6,085,838 | A * | 7/2000 | Vercaemer et al. | 166/277 |
| 6,189,616 | B1 | 2/2001 | Gano et al. | 166/298 |
| 2005/0092485 | A1* | 5/2005 | Brezinski et al. | 166/207 |

FOREIGN PATENT DOCUMENTS

| | | |
|---|---|---|
| FR | 2 741 907 | 6/1997 |
| WO | 99/13195 | 3/1999 |
| WO | 00/37766 | 6/2000 |
| WO | 02/14645 | 2/2002 |
| WO | 02/25056 | 3/2002 |
| WO | 02/066783 | 8/2002 |
| WO | WO 03/078790 | 9/2003 |

OTHER PUBLICATIONS

Great Britain Search Report, dated Aug. 11, 2003 for GB 0230189.3.

U.K. Search Report, Application No. GB 0329368.5, dated Jan. 23, 2004.

* cited by examiner

*Primary Examiner*—William Neuder
(74) *Attorney, Agent, or Firm*—Patterson & Sheridan, L.L.P.

(57) ABSTRACT

There is disclosed a method of forming a tubing lined borehole, the method comprising the steps of forming a borehole; enlarging part of the borehole by increasing the diameter thereof; and locating bore-lining tubing in the borehole with at least part of the tubing located in the enlarged part of the borehole, and a corresponding a tubing lined borehole.

There is also disclosed a downhole cutting tool comprising a tool body; and at least one cutting element mounted for radial movement with respect to the tool body between a retracted position and a cutting position, in the cutting position the cutting element describing a cutting diameter and an axially extending annular space inwardly of the cutting element, and a corresponding method.

38 Claims, 11 Drawing Sheets

DOWNHOLE CUTTING TOOL AND METHOD

CROSS-REFERENCE TO RELATED APPLICATIONS

This application claims benefit of Great Britain patent application serial number GB 0230189.3, filed Dec. 27, 2002, which is herein incorporated by reference.

BACKGROUND OF THE INVENTION

1. Field of the Invention

The present invention relates to a method of forming a tubing lined borehole and to a downhole cutting tool. In particular, but not exclusively, the present invention relates to a downhole cutting tool for use in enlarging an existing borehole. The invention also relates to a method of enlarging a borehole.

2. Description of the Related Art

In the oil and gas exploration and production industry, it is a common practice to drill a borehole to a desired depth for recovering well fluids from hydrocarbon-bearing rock formations. Logging procedures are carried out both before and during drilling of the borehole to determine physical characteristics of the rock formations. Typically, the borehole is drilled to a first depth before locating a metal casing of a first outer diameter in the borehole, suspending the casing from a wellhead, and cementing the casing in place. Further logging procedures are then carried out to determine more accurately the physical characteristics of the borehole at depth, and the borehole is then extended to a second depth by drilling a smaller diameter borehole extending from the upper, cased borehole.

This smaller diameter extension is then cased with a smaller diameter casing extending from the wellhead, which is also cemented in place to, inter alia, seal the intersection between the upper, larger casing and the smaller diameter casing. This process is continued until the borehole has been cased and cemented to a desired depth and completion procedures are then carried out to allow recovery of well fluids.

This traditional method of casing a borehole is both time-consuming and costly as it involves locating multiple lengths of casing in the borehole, each extending from the wellhead. This employs long lengths of expensive metal casing and large volumes of cement.

Furthermore, in the event of a problem being encountered during drilling of the borehole, such as drilling fluid being lost into a fractured or highly permeable formation, it is necessary to conduct remedial operations to overcome such problems. This typically involves running an additional length of casing back to the wellhead to isolate the problem formation.

Although this eventuality is allowed for during planning of the well, it is generally undesired and too many such occurrences can have a significant effect upon the final diameter of the borehole and thus the ability to conduct completion procedures.

Much research has been carried out in the industry in an effort to facilitate the creation of mono-bore wells: a mono-bore well is a borehole cased with tubing of a constant internal diameter, to avoid the need to provide multiple overlapping lengths of casing suspended from the wellhead.

To this end, expandable casing, liner and hanger systems are being developed in an effort to achieve a mono-bore well, which will also extend drilling capabilities by increasing the opportunities for use of intermediate and slim profile casing strings. Intermediate strings are used to cover problem areas, such as deteriorated casing, as a form of patch, whilst slim profile strings comprise relatively thin wall tubing which take up less space downhole.

However, various problems have been encountered. For example, to achieve a mono-bore cased borehole, it is necessary to form a "bell end" at the lower end of a casing string, to provide a recess into which the subsequent casing can be nested. This is not possible with existing casing strings because the casing is cemented into the wellbore. Accordingly, a hard cement material is located around the outside of the casing shoe (the last section of the upper or previous casing), which prevents the casing from being formed into a bell end.

The Applicant's International Patent Publication No. WO 02/25056 discloses a liner shoe including a compressible material defining an annular sleeve around an outer surface of a lower end of the shoe. This compressible material prevents cement from surrounding the end of the shoe when the liner is cemented, and allows the end to be subsequently diametrically expanded to form a bell end. However, the liner shoe cannot be used in existing well boreholes cased and cemented as described above.

It is amongst the objects of embodiments of the present invention to obviate or mitigate at least one of the foregoing disadvantages.

SUMMARY OF THE INVENTION

According to a first aspect of the present invention, there is provided a method of forming a tubing lined borehole, the method comprising the steps of:

forming a borehole;

enlarging part of the borehole; and locating bore-lining tubing in the borehole with at least part of the tubing located in the enlarged part of the borehole.

The method may comprise locating an end of the tubing in the enlarged part of the borehole.

Locating the bore-lining tubing in the borehole with part of the tubing in the enlarged borehole part provides an enlarged gap between an outer surface of the tubing part and a wall of the borehole. This allows for subsequent expansion of the tubing into the gap, or location of a second bore-lining tubing in the borehole with an end in the gap and overlapping the first tubing, as will be described below.

The method may comprise forming a borehole having a first bore diameter;

enlarging said part of the borehole to a second diameter greater than the first bore diameter; and locating said at least part of the tubing in the greater second diameter part of the borehole.

Preferably, the bore-lining tubing is located in the borehole before the borehole is enlarged. The method may further comprise cutting an annular gap around an outer surface of the bore-lining tubing. Preferably also, the method comprises locating a downhole cutting tool in an unlined portion of the borehole; rotating the cutting tool; and moving the cutting tool axially over the tubing to cut the annular gap. The method may further comprise moving a cutting element of the cutting tool from a retracted position to a cutting position where the cutting element describes an enlarged diameter which may be the second, greater diameter; rotating the cutting element; and moving the cutting element axially over the tubing. The tubing may be cemented before cutting of the annular gap. Further features of the method will be described below.

Alternatively, the borehole may be enlarged prior to locating bore-lining tubing in the borehole. For example, during drilling of the borehole, part of the borehole may be enlarged in a single run procedure, such as by using an expandable drill bit of the type disclosed in the Applicant's International Patent Publication No. WO 02/14645, or other suitable cutting tools, as will be described below. In a further alternative, the borehole may be enlarged using an under-reaming tool either concurrently with drilling of the borehole or subsequently, in a single run or a separate run, such as by running in a separate cutting tool for enlarging the borehole subsequent to an initial borehole drilling procedure.

The method may comprise locating bore-lining tubing including a section of tubing having a compressible material defining an annular sleeve around an outer surface thereof, of the type disclosed in the Applicant's International Patent Publication No. WO 02/25056. This allows cementation and subsequent expansion of the tubing in the region of the enlarged part of the borehole, or location of an expanded second tubing around the bore-lining tubing, as will be described below, by compression or deformation of the compressible material.

According to a further aspect of the present invention, there is provided a tubing-lined borehole comprising:

a first borehole part;

a larger second borehole part; and bore-lining tubing located in the borehole with at least part of the bore-lining tubing in the larger second borehole part.

Preferably, the bore-lining tubing is cemented in the borehole. Preferably also, there is an annular gap around an outer surface of said part of the bore-lining tubing located in the larger second borehole part.

According to still a further aspect of the present invention, there is provided a downhole cutting tool comprising:

a tool body; and at least one cutting element mounted for radial movement with respect to the tool body between a retracted position and a cutting position, in the cutting position the cutting element describing a cutting diameter and an axially extending space inwardly of the cutting element.

The space defined by the cutting element in the cutting position allows an annular gap to be back-cut or back-reamed around an outer surface of tubing located in a borehole by rotating the tool in the borehole with the cutting element in the cutting position. This essentially defines an undercut pocket behind the tubing, providing space for expansion of the tubing into the annular gap or, alternatively, for location of a second tubing in the gap around the first tubing. This facilitates provision of a mono-bore lined borehole.

The space may be defined between an inner surface of the cutting element and an outer surface of the body.

Preferably, the tool includes a plurality of cutting elements. The tool may include two cutting elements spaced 180° apart or any other suitable number of cutting elements at desired spacings.

The cutting element may comprise a cutting arm and may include at least one cutting face. The cutting element may include a cutting face on an axial end and may also include a cutting face on a radially outer surface. Preferably, the cutting element includes a plurality of cutting faces. The cutting face may include a plurality of cutting or abrading teeth or any other suitable cutting member.

The cutting element may be arcuate or curved in cross section. This allows the cutting element to cut an annular gap behind tubing in a borehole. It will be understood that the inner and outer diameter of the gap is determined by the inner and outer diameter described by the cutting element when in the cutting position, although the cutting element may take any other appropriate form and may be adapted for location in different cutting positions describing different cutting diameters.

Alternatively, the cutting element may comprise a fluid conduit for transportation of a cutting fluid through the cutting tool. The fluid conduit may include at least one nozzle for directing a stream or jet of cutting fluid from the tool to cut cement and/or rock around the tubing. The cutting fluid may include abrasive cutting particles for assisting in a cutting procedure. The cutting fluid may be adapted to carry entrained cuttings from the borehole.

In a further alternative, the cutting element may comprise a combined cutting arm and fluid conduit. Thus a cutting procedure may be carried out by a combination of mechanical and cutting fluid abrasion. In a still further alternative, the cutting tool may comprise at least one cutting arm and at least one fluid conduit.

The cutting element may be releaseably coupled to the body. This allows the cutting element to be removed for maintenance, or for replacement with a replacement or alternative cutting element when the existing element becomes worn, or when it is desired to cut an annular gap of alternative dimensions. This facility may also be useful if the cutting element becomes locked, jammed or otherwise stuck in the extended cutting position, allowing the remainder of the tool to be retrieved.

The cutting element may be moveable between the retracted position and the cutting position in response to an applied fluid pressure. For example, a hydraulic fluid may be supplied to the tool to move the cutting element between the retracted and the cutting positions and for maintaining the cutting element in a selected position. Alternatively, the cutting element may be moved in response to circulation of fluid, such as drilling fluid, through the tool. This may also lubricate and cool the cutting tool in use. Where the cutting element comprises a fluid conduit, the cutting element may be moveable in response to cutting fluid supplied to the tool.

In a further alternative embodiment, the cutting element may be electronically, electrically, mechanically or electro-mechanically moveable between the retracted position and the cutting position. In a still further alternative embodiment, the cutting element may be moveable between the retracted position and the cutting position by rotation of the cutting tool. Thus rotation of the tool body may move the cutting element to the cutting position. The cutting element may be biassed towards the retracted position and may be spring or otherwise biassed. This may act as a fail-safe to move the cutting element towards the retracted position.

The cutting element may be disposed substantially parallel to an axis of the tool body when in one or both of the cutting and retracted positions.

The cutting tool may include or may be adapted to be coupled to a debris collection device such as a junk basket. This may allow collection of cuttings generated in a cutting procedure using the tool. The space defined between the cutting element and the body may allow passage of cuttings from the cutting element past or through the tool. Accordingly, the collection device may be provided axially below the space such that cuttings falling from the space are collected by the junk basket.

The tool may further comprise a separate, main cutting element for enlarging a borehole in which the cutting tool is to be located, in particular, for enlarging a length or section of the borehole to a greater internal diameter. This may facilitate location of the tool in the borehole and provides a space for accommodating the cutting element when it is moved to the cutting position. The tool may include conventional cutting elements or cutting elements of the type disclosed in the Applicant's International Patent Publication No WO 02/14645. Alternatively, the tool may form part of a tool assembly including a conventional underreamer or an underreamer of the type disclosed in WO 02/14645. The tool may also form part of an assembly including a tubing expansion tool, such as a rotary expansion tool of the type disclosed in the Applicant's International Patent Publication No. WO 00/37766.

According to a yet further aspect of the present invention, there is provided a cutting element adapted to describe a cutting diameter at least equal to an external diameter of tubing located in a borehole, for cutting an annular gap behind the tubing.

The cutting element may define a cutting diameter approximately equal to the external diameter of the tubing. The cutting element, when in a retracted position, may define a diameter less than an internal diameter of the tubing. Further features of the cutting element are defined above.

According to a yet further aspect of the present invention, there is provided a method of enlarging an at least partly tubing-lined borehole, the method comprising the steps of:

locating a downhole cutting tool in an unlined portion of the borehole;

moving a cutting element of the cutting tool from a retracted position to a cutting position where the cutting element describes a cutting diameter;

rotating the cutting element; and moving the cutting element axially over an end of the tubing to cut an annular gap around an outer surface of the tubing.

As will be described, this facilitates drilling of a borehole to a desired depth at a substantially constant internal bore diameter.

The method may further comprise drilling a borehole, locating the tubing in the borehole and cementing the tubing. This is in accordance with standard procedures conducted in the industry. It will be understood that, following location of tubing in a borehole in this fashion and cementing of the tubing, a hard cemented and substantially uncompressible material is provided around the outside of the tubing, preventing the tubing from being expanded. The invention therefore allows a gap to be cut in this material around the tubing, enabling subsequent expansion of the tubing or location of an expanded second tubing around the first tubing.

The borehole may be enlarged, that is, the internal diameter increased, below or beyond the tubing and the cutting tool may subsequently be located in the enlarged portion of the borehole. The borehole may be enlarged by any suitable method, such as using a conventional underreaming tool, an underreaming tool of the type disclosed in WO 02/14645, a bi-centre bit, or an expandable drill bit.

The cutting element may be moved to the cutting position to define an axially extending space between an inner face of the cutting element and an outer face of the tool body. As the cutting element moves axially over the end of the tubing, the tubing is accommodated in the axially extending space.

The cutting element may be moved to a position defining a minimum cutting diameter at least equal to an outer diameter of the tubing. In this fashion, when the annular gap around the tubing is cut, there is little or no damage to the tubing. It will be understood that the cutting procedure may remove cement from around the end of a tubing to allow the tubing to be expanded, or to allow location of an expanded second tubing in the resulting annular gap. Accordingly, it may be necessary only to remove sufficient cement to allow expansion of the tubing, or location of the second tubing around the first tubing. If desired, the cutting element may be moved to a position defining a minimum cutting diameter smaller than an outer diameter of the tubing. In this fashion, part of the tubing may be cut away to ensure good surface contact with a second expanded tubing located in the annular gap.

The cutting element may be moved axially by axial movement of the cutting tool. Alternatively, the cutting element may be independently axially moveable with respect to a body of the cutting tool.

The method may further comprise running the cutting tool through the tubing with the cutting element in the retracted position and subsequently moving the cutting element to the cutting position following location of the cutting tool in the unlined portion of the borehole.

The method may further comprise collecting material cut by the cutting element, for subsequent removal from the borehole. This may prevent build-up of cuttings in the borehole.

The method may comprise mechanically abrading to cut the annular gap, or directing a cutting fluid through the cutting element to cut the annular gap, or a combination of the two. The cutting fluid may be jetted through a nozzle of the cutting element and may include abrasive particles, to assist in the cutting procedure. The fluid may be supplied to the tool at high pressure, to generate a high velocity jet of cutting fluid for cutting the annular gap.

Further features of the method will be defined below.

According to a yet further aspect of the present invention, there is provided a method of lining a borehole, the method comprising the steps of:

cutting an annular gap around an end of a first tubing located in the borehole;

expanding the end of the first tubing to a larger diameter;

expanding a smaller diameter second tubing; and locating an end of the second tubing in the expanded end of the first tubing.

It will be understood that the annular gap is cut around a lower or distal end of the first tubing, and that an upper or proximal end of the second tubing is located in the expanded end of the first tubing. Thus, in the case of, for example, a deviated borehole where the first tubing may extend horizontally, the gap is cut around a distal end of the tubing which is farthest along the borehole.

Preferably, the smaller diameter second tubing is located overlapping the end of the first tubing following expansion of the first tubing and before expansion of the second tubing. This allows the second tubing to be expanded into contact with the first tubing, which may provide a seal between the tubings. Alternatively, the second tubing may be located in the end of the first tubing before expansion of the first tubing. Thus subsequent expansion of the second tubing may also expand the first tubing. The end of the second tubing may be located within the end of the first tubing.

Alternatively, the second tubing may be expanded while located in an unlined portion of the borehole adjacent an end of the first tubing. The first tubing end may be expanded to an internal diameter approximately equal to an external diameter of the expanded smaller second tubing. This allows the expanded smaller tubing to be located within the expanded end of the first tubing by moving the second tubing axially into engagement with the first tubing. The respective diameters may be selected such that there may be a relatively tight fit between the first and second tubings.

According to a yet further aspect of the present invention, there is provided a method of lining a borehole, the method comprising the steps of:

cutting an annular gap around an end of a first tubing located in the borehole;

locating a smaller diameter second tubing in an unlined portion of the borehole adjacent the end of the first tubing;

expanding the smaller diameter second tubing; and locating an end of the second tubing around the end of the first tubing.

The second tubing may be located around the end of the first tubing at least partly by frictional contact between the end of the second tubing and the end of the first tubing.

At least an end of the second tubing may be expanded to an internal diameter approximately equal to an external diameter of the first tubing. This may allow the second tubing to be located around the first tubing in a close fit.

The method may further comprise cementing the first tubing in the borehole. Thus, the cutting element may cut an annular gap in the cement and/or a wall of the borehole around the end of the first tubing. Following location of the second tubing, the interface between the first and second tubings may be cemented and at least part of an annulus between the second tubing and the borehole may also be cemented.

The step of cutting an annular gap around the first tubing may comprise the steps of enlarging a borehole in accordance with the third aspect of the present invention.

The second tubing may be expanded to an internal diameter at least equal to an internal diameter of the first tubing. Accordingly, the borehole may be lined to a desired depth with mono-bore casing. Alternatively, the second tubing may be expanded at least partly to a greater internal diameter than the internal diameter of the first tubing. Accordingly, part of the borehole may be lined with a larger diameter tubing.

The second tubing may be run into the first tubing and suspended from a string of support tubing extending to surface. This provides a connection with the second tubing which facilitates movement of the second tubing to a desired location following expansion of the second tubing.

The first and second tubings may be expanded by any desired suitable method but are preferably expanded using a rotary expansion tool of the type disclosed in the Applicant's International Patent Publication No. WO 00/37766.

BRIEF DESCRIPTION OF THE DRAWINGS

Embodiments of the present invention will be now be described, by way of example only, with reference to the accompanying drawings, in which.

DETAILED DESCRIPTION OF THE PREFERRED EMBODIMENT

Figure 1:
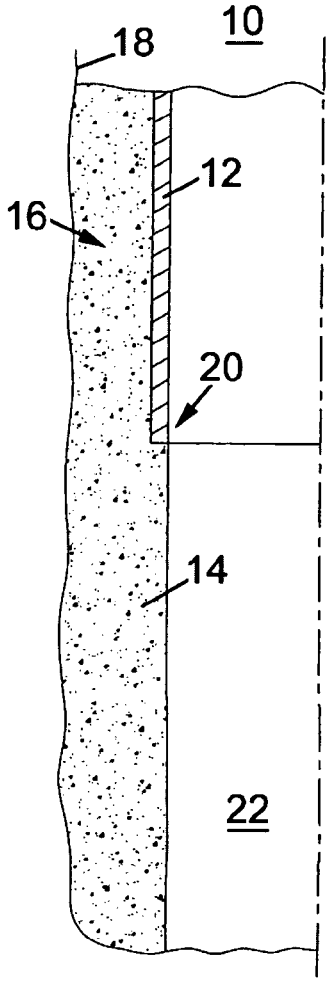
FIG. 1 is a schematic half-sectional illustration of a borehole partially lined with a first tubing to a first depth and extended beyond an end of the first tubing to a second depth.

Turning firstly to FIG. 1, there is shown a schematic half-sectional illustration of a borehole 10 which has been partially lined with a first tubing in the form of a borehole casing 12. A shoe 20 of the casing is shown in the figures, which is the lowermost or deepest section of casing 12 in the borehole. The casing 12 has been cemented in the borehole 10 by pumping cement 14 into an annulus 16 defined between the borehole wall 18 and the casing 12 in first steps of a method of forming a tubing-lined borehole. FIG. 1 shows the borehole after the cement 14 has set and the borehole 10 continued by drilling a smaller diameter bore extending from an end of the casing shoe 20, this smaller diameter bore portion being initially unlined and indicated by reference numeral 22.

Figure 2:
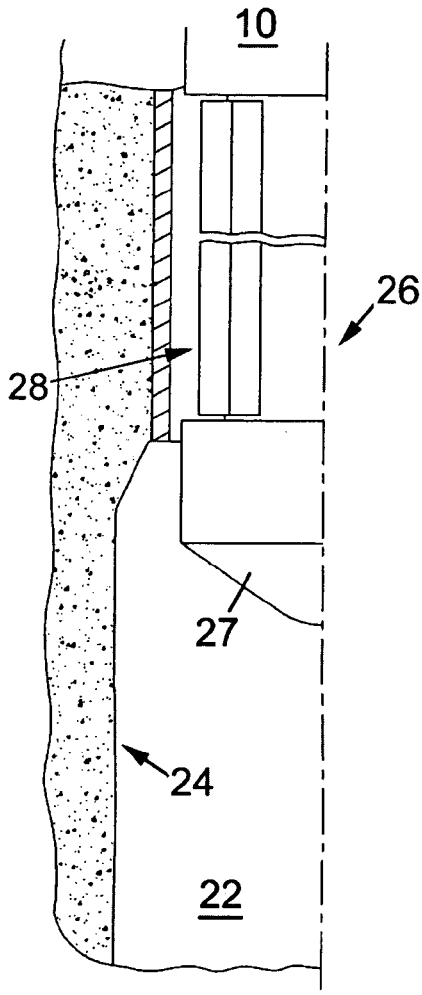
FIG. 2 is a view of the borehole of FIG. 1 following an underreaming procedure where the borehole has been enlarged at a level axially below the tubing, and showing one half of a cutting tool in accordance with a preferred embodiment of the present invention during running in and with a cutting element of the tool in a retracted position.

The unlined portion 22 of the borehole is then enlarged in the region 24 axially below the end 20 of the casing 12, as shown in FIG. 2, using a conventional underreaming tool, or an underreaming tool of the type disclosed in WO 02/14645, or an expandable or bi-cone drill bit. A downhole cutting tool in accordance with a preferred embodiment of the present invention is then run into the borehole 10, the tool indicated generally by reference numeral 26. Only half of the tool 26 is shown in FIG. 2, with a cutting element 28 of the tool in a retracted position, which allows the tool to be run through the casing 12. However, the other half of the tool 26 is of a similar structure, as will be described below with reference to FIG. 3. The tool 26 is located in the unlined borehole portion 22 adjacent the underreamed section 24, below the end 20 of the casing 12. The tool 26 is shown during run-in in the bottom view of FIG. 3. The tool 26 is run into the casing 12 and controlled through a string 30 extending to surface and which allows rotation of the cutting tool 26 for cutting an annular gap around the end 20 of the casing 12, as will be described below, in a back-reaming procedure.

Figure 3:
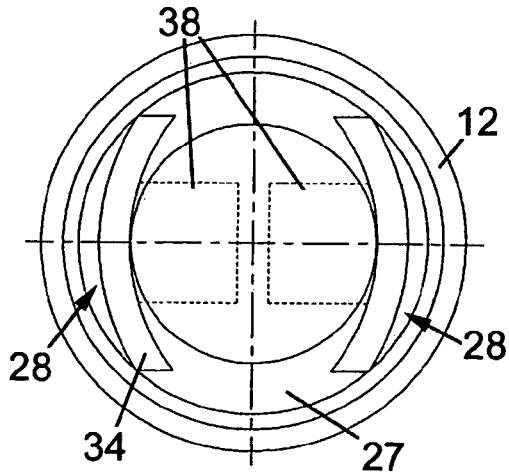
FIG. 3 is a view of the cutting tool in the running position of FIG. 2, taken from above and shown without a string couple to the tool, for clarity.

The cutting tool 26 includes a tool nose 27 and a tool body 32, to which two cutting elements 28 are mounted for movement between the retracted position of FIG. 2 and an extended, cutting position. The cutting elements comprise arcuate arms or plates, as best shown in FIG. 3, which include an end cutting face 34 on leading edges of the tool and a side cutting face 36, for cutting and abrading the cement 14. The cutting faces 34, 36 include cutting structures such as abrasive particles and cutting teeth of a type known in the field of downhole cutting tools. For example, the cutting faces may include PDC diamond or Tungsten Carbide cutting structures. Each cutting arm 28 is mounted on a respective piston 38 in a cylinder 40 of the tool body, for movement between the retracted and extended positions in response to an applied fluid pressure. This may be achieved by supplying hydraulic fluid through a conduit (not shown) extending to surface through the string 30, or by circulating fluid through the tool 26, such as a drilling fluid. The drilling fluid may also serve to cool the tool 26 in use and, optionally, to carry entrained drill cuttings to surface. The tool also includes a return spring for moving each cutting element 28 to the retracted position after the cutting procedure has been completed.

Figure 4:
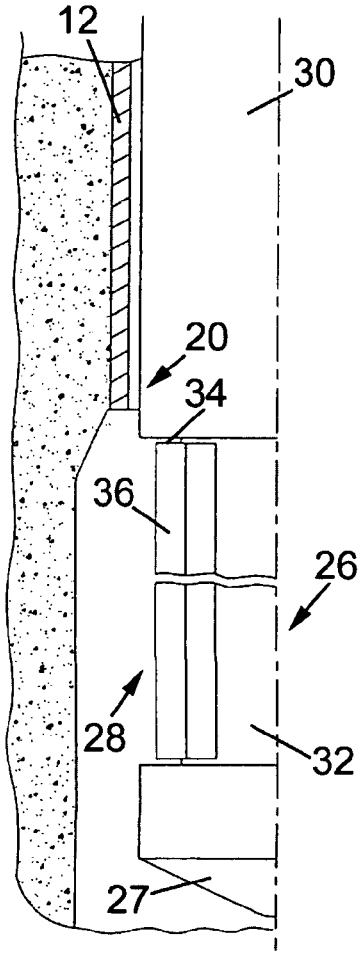
FIG. 4 is a view of the borehole of FIG. 2 following location of the cutting tool in an unlined portion of the borehole.
Figure 5:
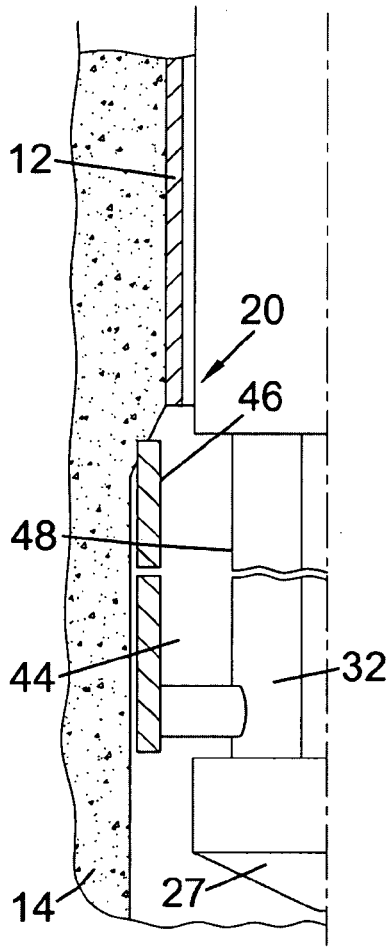
FIG. 5 is a view of the borehole of FIG. 2 following movement of a cutting element of the cutting tool to an extended position.
Figure 6:
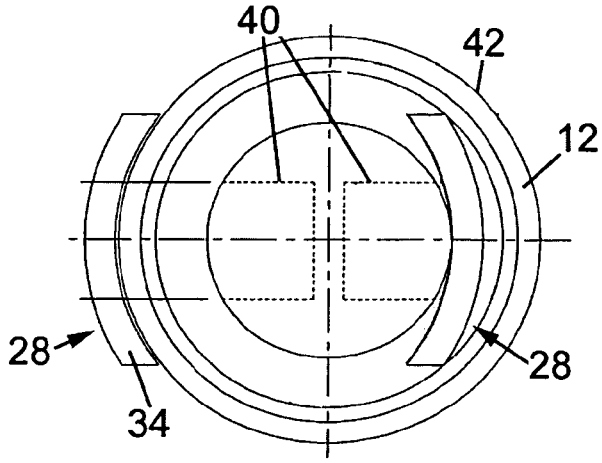
FIG. 6 is a view of the cutting tool illustrating a cutting element of the cutting tool in the extended position (left half of FIG. 6) and a cutting element in the retracted position (right half of FIG. 6), taken from above, in a similar fashion to the view of FIG. 3.

Accordingly, following location of the cutting tool in the position of FIG. 4, the pistons 38 are urged radially outwardly in their cylinders 40, carrying the cutting arms 28 radially outwardly to their extended, cutting positions shown in FIG. 5. The cutting arms 28 define a close fit around an outer surface 42 of the casing, as shown in particular in the bottom view of FIG. 6. FIG. 6 shows one of the cutting arms 28 in the extended position and one in the retracted position to illustrate the relative degree of movement of the cutting arms.

With the cutting arms in the cutting position, the cutting tool 26 is rotated either from surface by rotating the string 30 using, for example, a rotary table or top drive on a drill rig, or by a dedicated drilling motor such as a downhole turbine or positive displacement motor (PDM) coupled to the cutting tool 26 to begin to cut the cement, as shown in FIG. 5.

The cutting tool 26 is then lifted to move the tool axially towards the end 20 of the casing 12. In the extended position of the cutting arms 28, an axially extending space 44 is defined between an inner surface 46 of the cutting arms and an outer surface 48 of the tool body 32. During movement of the cutting tool 26 towards the end 20 of the casing 12, the cutting arms 28 begin to abrade and cut into the cement 14 surrounding the casing end 20. As the cutting arms 28 move upwardly, the arms overlap the casing end 20, which is received in the space 44.

Figure 7:
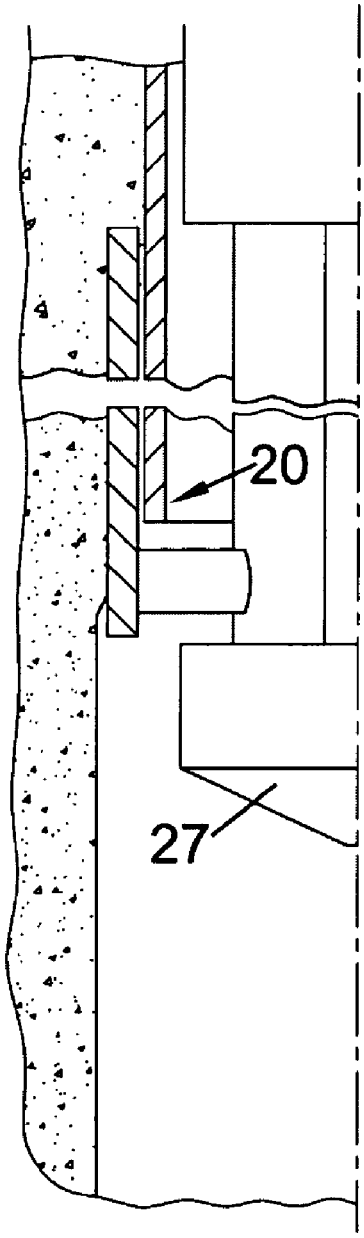
FIG. 7 is a view of a the borehole of FIG. 2 shown during enlargement of the borehole by cutting an annular gap around an outer surface of the tubing with the cutting tool.
Figure 8:
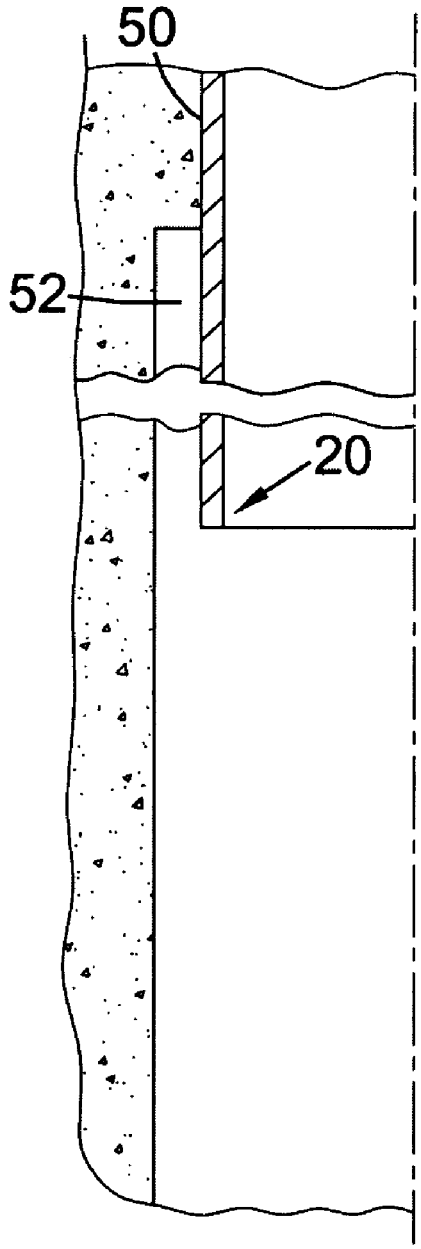
FIG. 8 is a view of the borehole following completion of cutting of the annular gap and removal of the cutting tool.

Movement of the cutting tool 26 continues until the annular cut has been extended to a desired length along an outer surface 50 of the casing 12, as shown in FIG. 7. Cuttings created by the tool 26 fall through the space 44 and are collected by a junk basket (not shown) axially below the tool and subsequently returned to surface. The cutting tool 26 is then moved downwardly back to the position of FIG. 5 and the cutting arms 28 are returned to their retracted position of FIG. 4, by bleeding off fluid pressure or by stopping or reducing the flow rate of fluid through the cutting tool. The cutting tool 26 is then returned to surface and an annular gap or undercut pocket 52 has thus been cut around the outer surface 50 of the casing lower end 20, as shown in FIG. 8.

The borehole portion 22 is then lined with a second tubing in one of two distinct methods.

Figure 9:
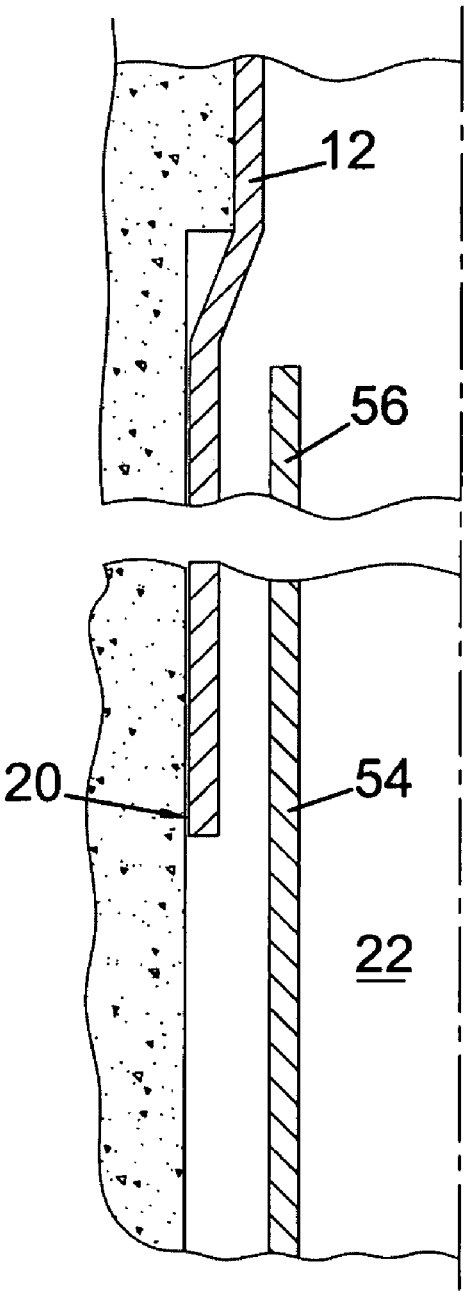
FIG. 9 is a view of the borehole of FIG. 8 following expansion of an end of the first tubing and subsequent location of a smaller diameter expandable second tubing in the first tubing, in accordance with an embodiment of a method of the present invention.
Figure 10:
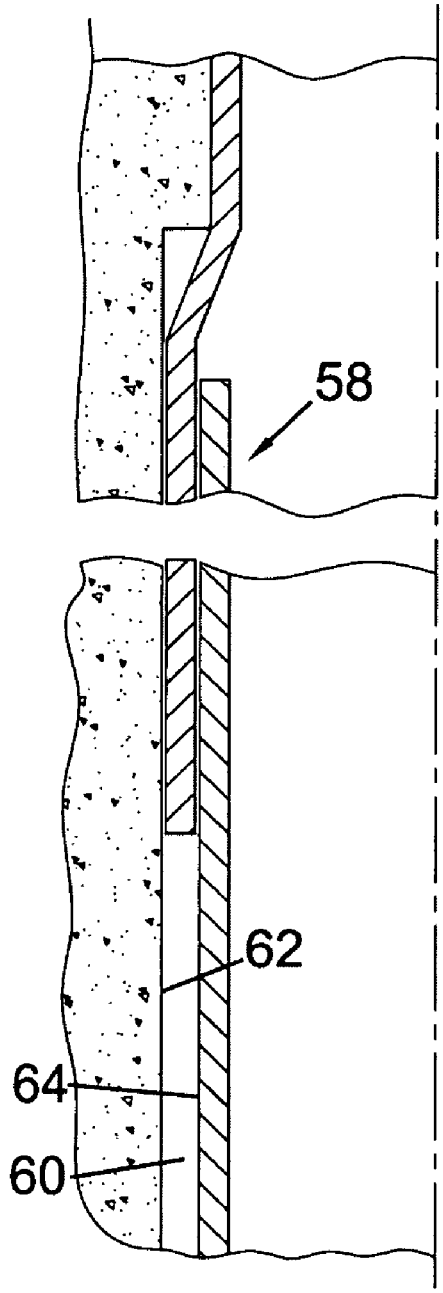
FIG. 10 is a view of the borehole of FIG. 9 following expansion of the second tubing.

Turning firstly to FIG. 9, according to a first method, a tubing expansion tool such as a rotary expansion tool of the type disclosed in the Applicant=s earlier International patent publication No. WO 00/37766 is run into the borehole 10, and the end 20 of the casing 12 is expanded radially outwardly into the annular gap 52 surrounding the casing end. This expansion of the casing end is referred to as forming a "bell end" on the casing and allows a smaller diameter expandable second tubing in the form of an expandable casing 54 to be coupled to the upper casing 12. This is achieved by running the expandable casing 54 into the borehole 10 and locating an upper end 56 of the casing 54 overlapping the expanded end 20 of the casing 12. It will be understood that the casing 54 is suspended from a string of tubing extending to surface which is not shown for clarity purposes. The string ideally contains the rotary expansion tool for subsequently expanding the casing 54. The rotary expansion tool is then activated to expand the upper end 56 radially outwardly into contact with the casing 12 lower end 20, sealing the second casing 54 to the upper casing 12. The expansion tool is then run down through the casing 54 in a top-down expansion procedure, to diametrically expand the casing 54 to the same internal diameter as the upper casing 12, as shown in FIG. 10. The rotary expansion tool is then retracted and returned to surface.

Figure 11:
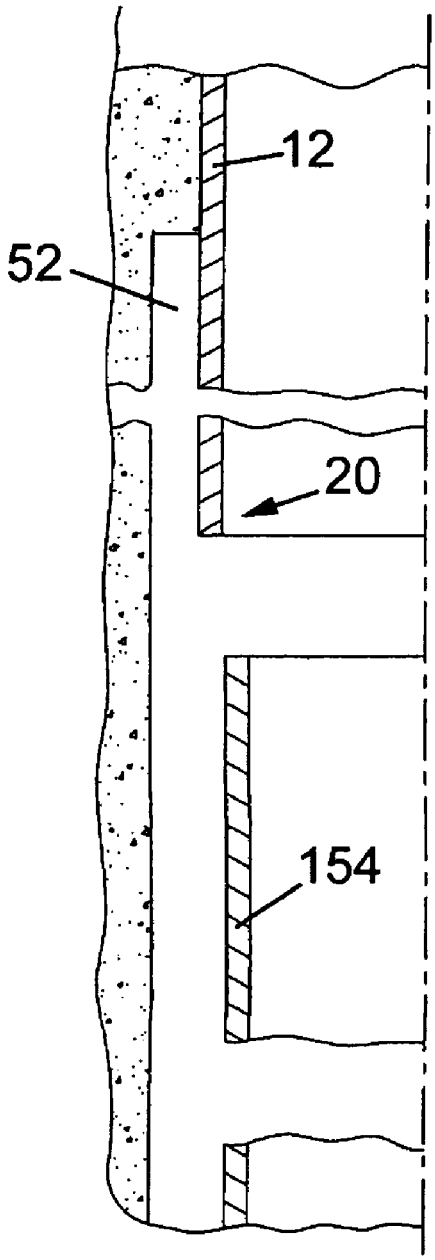
FIG. 11 is a view of the borehole of FIG. 8 following location of a smaller diameter expandable second tubing in an unlined portion of the borehole, in accordance with an alternative embodiment of a method of the present invention.
Figure 12:
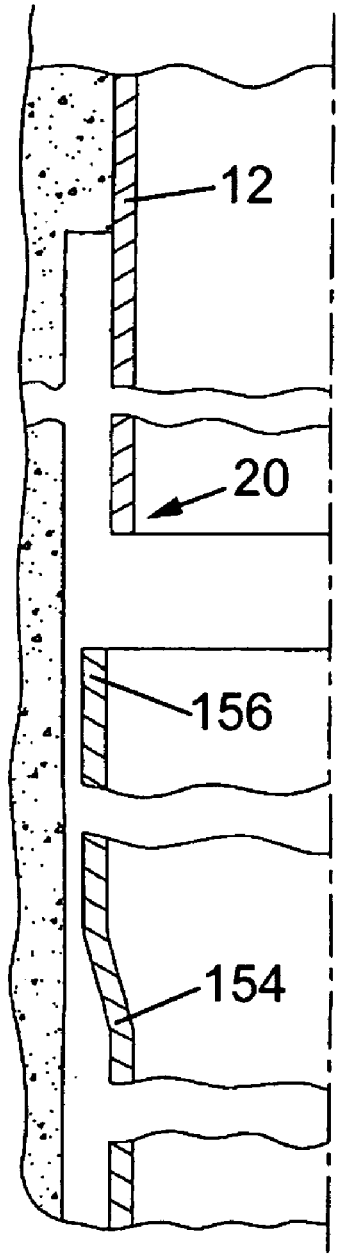
FIG. 12 is a view of the borehole of FIG. 11 following expansion of the second tubing.
Figure 13:
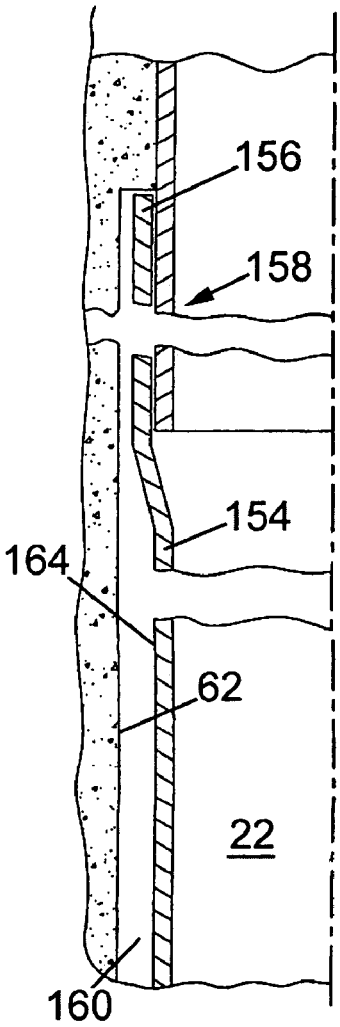
FIG. 13 is a view of the borehole of FIG. 12 following location of an end of the second tubing within the annular gap around the first tubing.

An alternative method of lining the portion 22 of the borehole 10 is shown in FIGS. 11–13.

As shown in FIG. 11, an expandable casing 154 is located in the unlined borehole portion 22 following cutting of the annular gap 52 using the cutting tool 26. In a similar fashion to the casing 54 of FIGS. 9 and 10, the casing 154 is suspended by a string extending to surface. An upper end 156 of the casing 154 is then expanded using a rotary expansion tool as shown in FIG. 12, to form the upper end 156 of the second casing into a "bell-top". This facilitates subsequent location of the second casing upper end 156 around the lower end 20 of the upper casing 12.

The second casing upper end 156 is typically expanded to an internal diameter either the same or slightly smaller than the external diameter of the casing 12. Accordingly, following expansion, the second casing 154 is pulled axially upwardly such that the end 156 passes over and overlaps the lower end 20 of the upper casing 12 in a friction-fit. Alternatively, the second casing upper end 156 may be expanded to an internal diameter slightly larger than the external diameter of the casing 12, to account for elastic recovery, or a seal sleeve or the like (such as an elastomeric or rubber sleeve) may be located between the casings 12, 154. It will be understood that the casing 12 shown in FIG. 9 may be expanded according to similar principles to obtain a sealed fit with the second casing 54.

The portion of the second casing 154 below the upper end 156 is expanded by the rotary expansion tool to an internal diameter equal to the internal diameter of the upper casing 12, and the expansion tool is then retracted and return to surface.

In each case, following location of the second casings 56, 156 the interface 58, 158 between the upper casing 12 and the second casing 56, 156 is cemented to seal an annulus 60, 160 defined between the wall 62 of the borehole portion 22 and an outer surface 64, 164 of the second casing 154.

Accordingly, following location and cementing of the second casing, the borehole 10 has been extended to a greater depth, lined and cemented, defining a substantially constant bore diameter.

Figure 14:
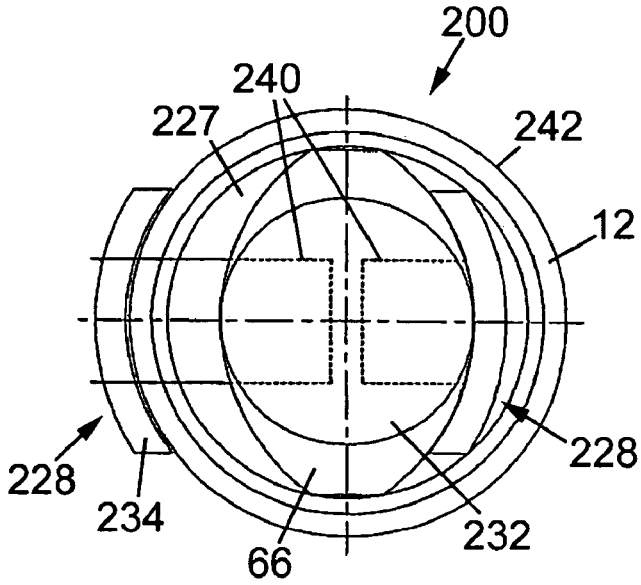
FIG. 14 is a view similar to FIG. 6 of a cutting tool in accordance with an alternative embodiment of the present invention, illustrating a cutting element of the tool in an extended position (left half of FIG. 14) and a cutting element in a retracted position (right half of FIG. 14)

Turning now to FIG. 14, there is shown a view of a cutting tool in accordance with an alternative embodiment of the present invention, the tool indicated generally by reference numeral 200. The tool 200 is of a similar structure to the tool 10 shown in FIGS. 2 to 7, and like components share the same reference numerals incremented by 200. The tool 200 differs from the tool 10 in that the tool body 232 carries a generally oval portion 66 which provides additional support for the tool cutting arms in the retracted position, as shown in the right half of FIG. 14.

Figure 15:
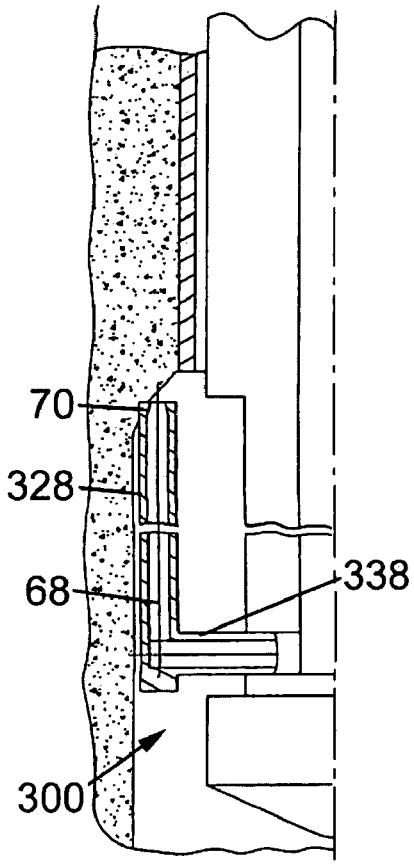
FIG. 15 is a view similar to FIG. 5 of one half of a cutting tool in accordance with an alternative embodiment of the present invention, shown following movement of a cutting element of the cutting tool to an extended position.

Turning now to FIG. 15, there is shown a view similar to FIG. 5 of one half of a cutting tool in accordance with an alternative embodiment of the present invention, indicated generally by reference numeral 300. The cutting tool 300 is shown in FIG. 15 following movement of a cutting element 328 to an extended position.

Figure 16:
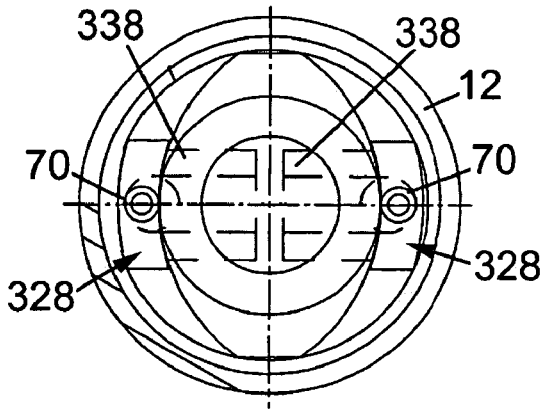
FIG. 16 is a view of the cutting tool of FIG. 15, taken from above but showing cutting elements of the cutting tool in retracted positions.
Figure 17:
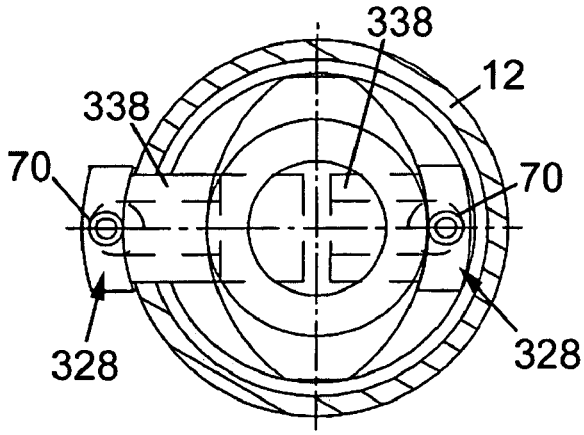
FIG. 17 is a view of the cutting tool of FIG. 15 illustrating a cutting element in the extended position (left half of FIG. 17) and a cutting element in the retracted position (right half of FIG. 17), taken from above, in a similar fashion to FIG. 16.

FIG. 16 is a view of the cutting tool 300 showing the cutting elements 328 in retracted positions, whilst FIG. 17 is a view illustrating one cutting element in the extended position (left half of FIG. 17) and one in the retracted position (right half of FIG. 17). The cutting element 328 comprises a fluid conduit 68 including a nozzle 70, for directing a jet of cutting fluid to cut the annular gap 52 around the end 20 of the borehole casing 12 when the cutting tool 300 is advanced over the end of the casing as shown in FIG. 18.

The cutting elements 328 include pistons 338 and are moved radially outwardly when a cutting fluid is supplied to the tool. The cutting fluid is directed through the conduit 68 and is jetted from the nozzle 70 to cut the gap 52. At the same time, the tool 300 is rotated and the two cutting elements 328 together cut the annular gap. The cutting fluid optionally includes abrasive cutting particles to assist in the cutting action and is jetted at high velocity to cut the cement surrounding the end 20 of the casing 12. The cutting fluid also assists with carrying entrained cuttings from the gap 52 during the cutting procedure.

Figure 18:
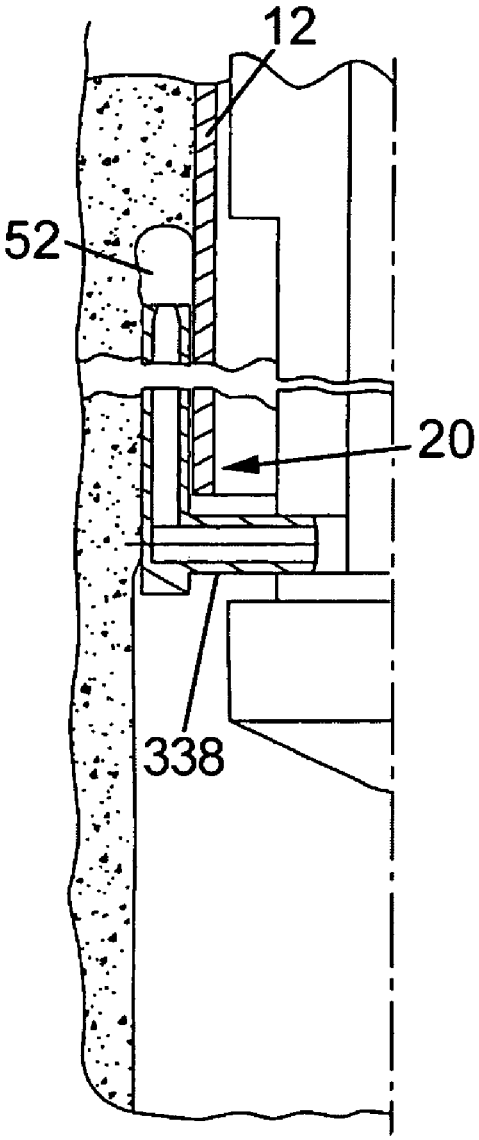
FIG. 18 is a view showing a borehole during enlargement by cutting an annular gap around an outer surface of borehole tubing with the cutting tool of FIG. 15.
Figure 19:
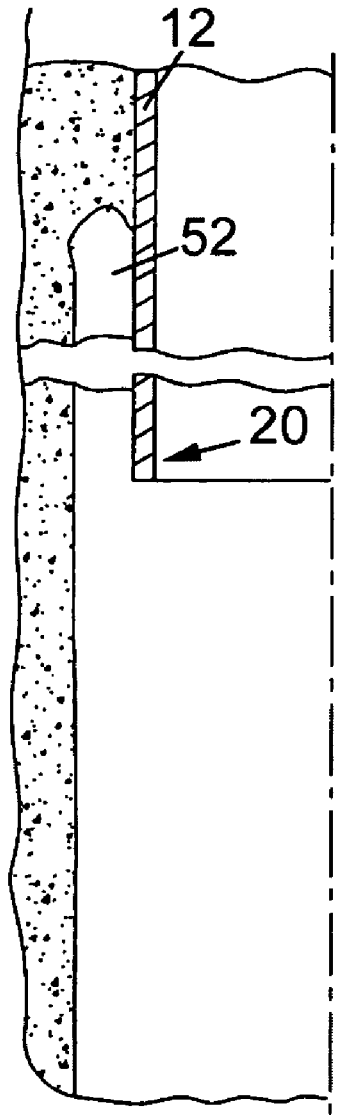
FIG. 19 is a view of the borehole following completion of cutting of the annular gap and removal of the cutting tool.

When the gap has been cut to a desired length behind the borehole casing 12 as shown in FIG. 18, the tool 300 is returned to the position of FIG. 15. Fluid circulation through the tool is then stopped, allowing the cutting elements 328 to return to the retracted position of FIG. 16, such that the tool may be returned to surface. The borehole is then completed using either of the methods described above in relation to FIGS. 9 and 10 or FIGS. 11–13, respectively.

In a further alternative embodiment of the invention (not shown) cutting elements may be provided combining both abrasive cutting faces such as the faces 34 and 36 of the tool 10 with a cutting fluid directed through a conduit such as the conduit 68 and nozzle 70 of the tool 300, to provide a combined abrasive cutting action.

Figure 20:
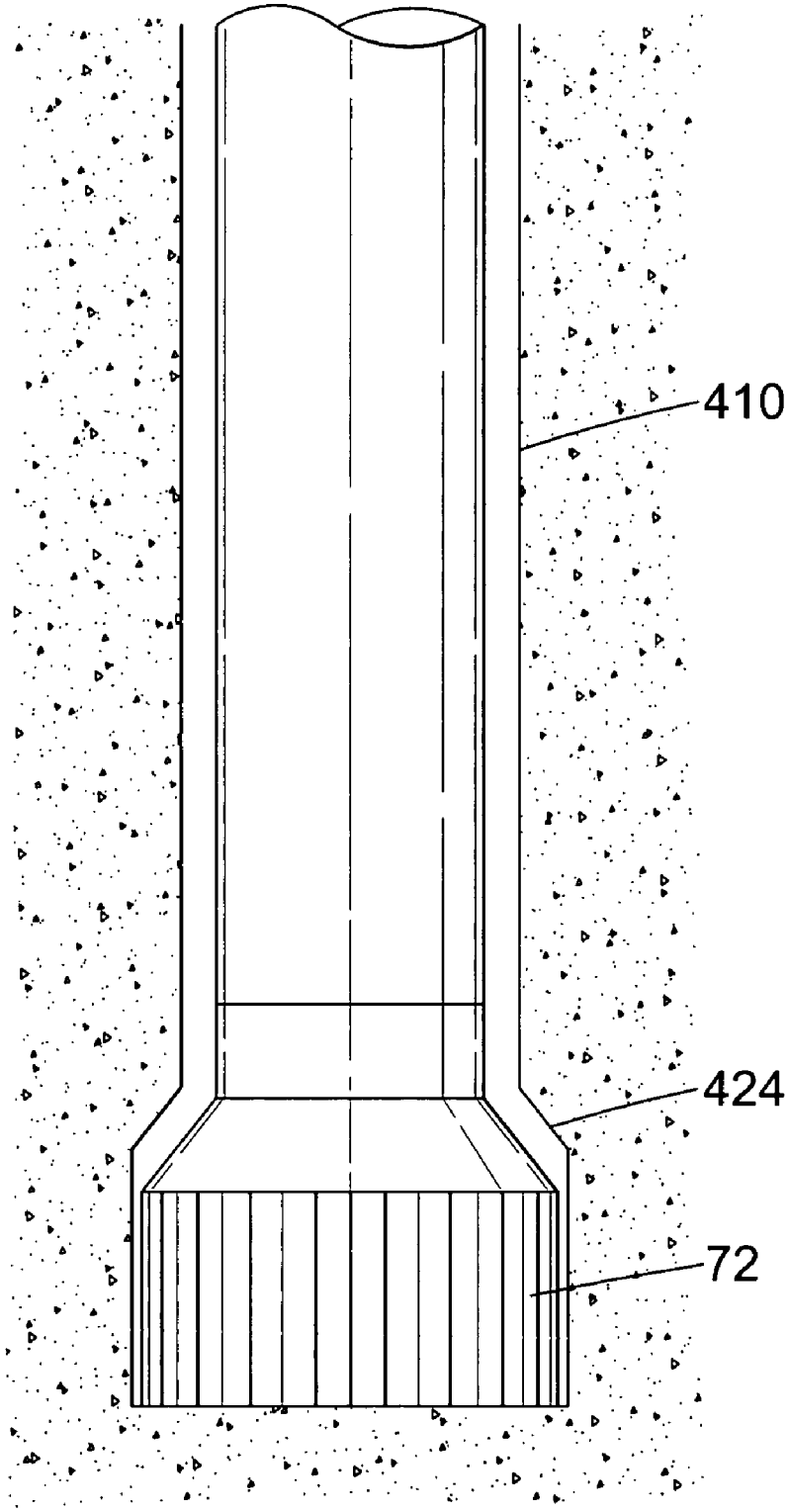
FIGS. 20 to 23 are schematic, partial longitudinal sectional views illustrating steps an alternative methods of forming a tubing-lined borehole.

Turning now to FIG. 20, there are shown initial steps in a method of forming a tubing lined borehole in accordance with an alternative embodiment of the present invention. FIG. 20 schematically illustrates the cutting of a borehole 410 using an expandable drill bit 72 of the type disclosed in the Applicant's International patent publication No. WO02/14645. The drill bit 72 is used in a first configuration to drill the borehole section 410, and is then expanded to a configuration in which the drill bit defines a larger, second diameter for drilling an underreamed section 424. The drill bit 72 is shown in the second configuration during drilling of the underreamed section 424.

Following underreaming of the section 424 along a desired length of borehole, a section of borehole casing (not shown) is located in the borehole 410 extending into the underreamed section 424, in a similar fashion to the casing 12 shown in FIG. 8. The casing is then expanded according to the method described above in relation to FIGS. 9 and 10, with a further section of expandable casing (not shown) subsequently located and expanded into contact with the upper casing as described above.

Alternatively, a further expandable casing (not shown) is located in the underreamed section 424, expanded and pulled over an axial end of the upper casing according to the method described in relation to FIGS. 11–13.

Figure 21:
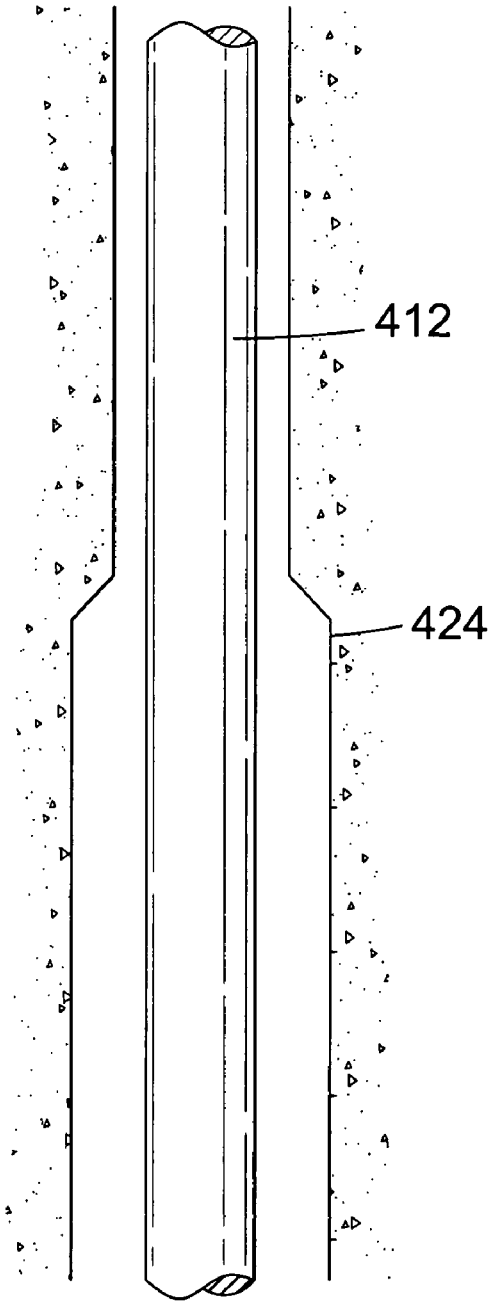
Figure 22:
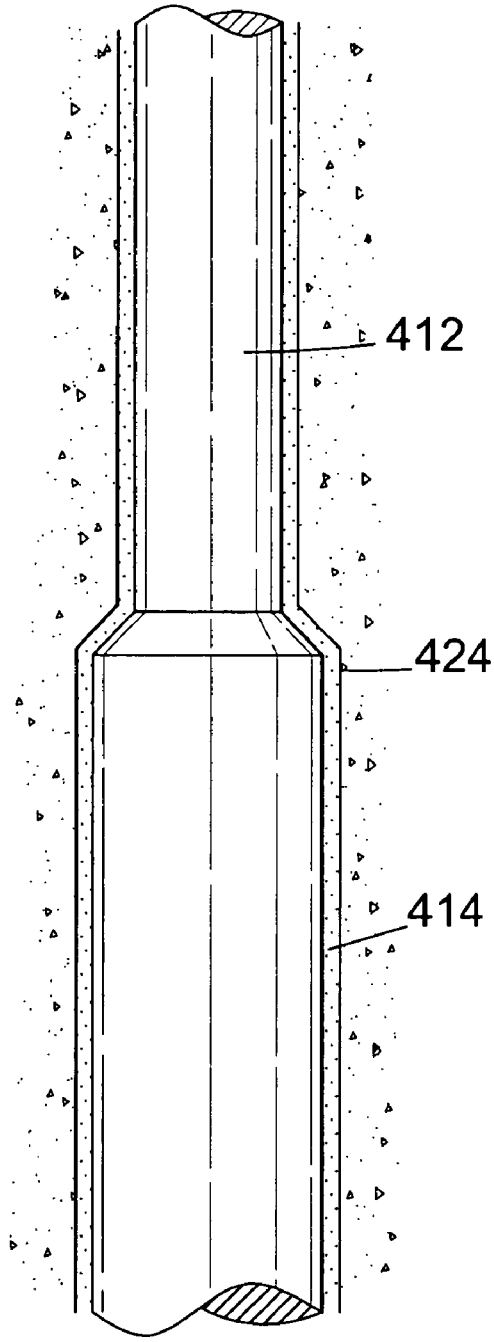

In a further alternative illustrated in FIGS. 21 and 22, expandable casing 412 may be located extending through the underreamed section 424 (FIG. 21) and subsequently expanded (FIG. 22). The casing 412 in the region of the underreamed section 424 may therefore be of a larger diameter than the part of the casing in the portion of the borehole which has not been underreamed. The casing may be expanded as shown at 414 in FIG. 22, before cementation, or after cementation and following undercutting as described above, or by isolating part of the underreamed section 424 to prevent cement filling the area between the casing and the underreamed section.

Figure 23:
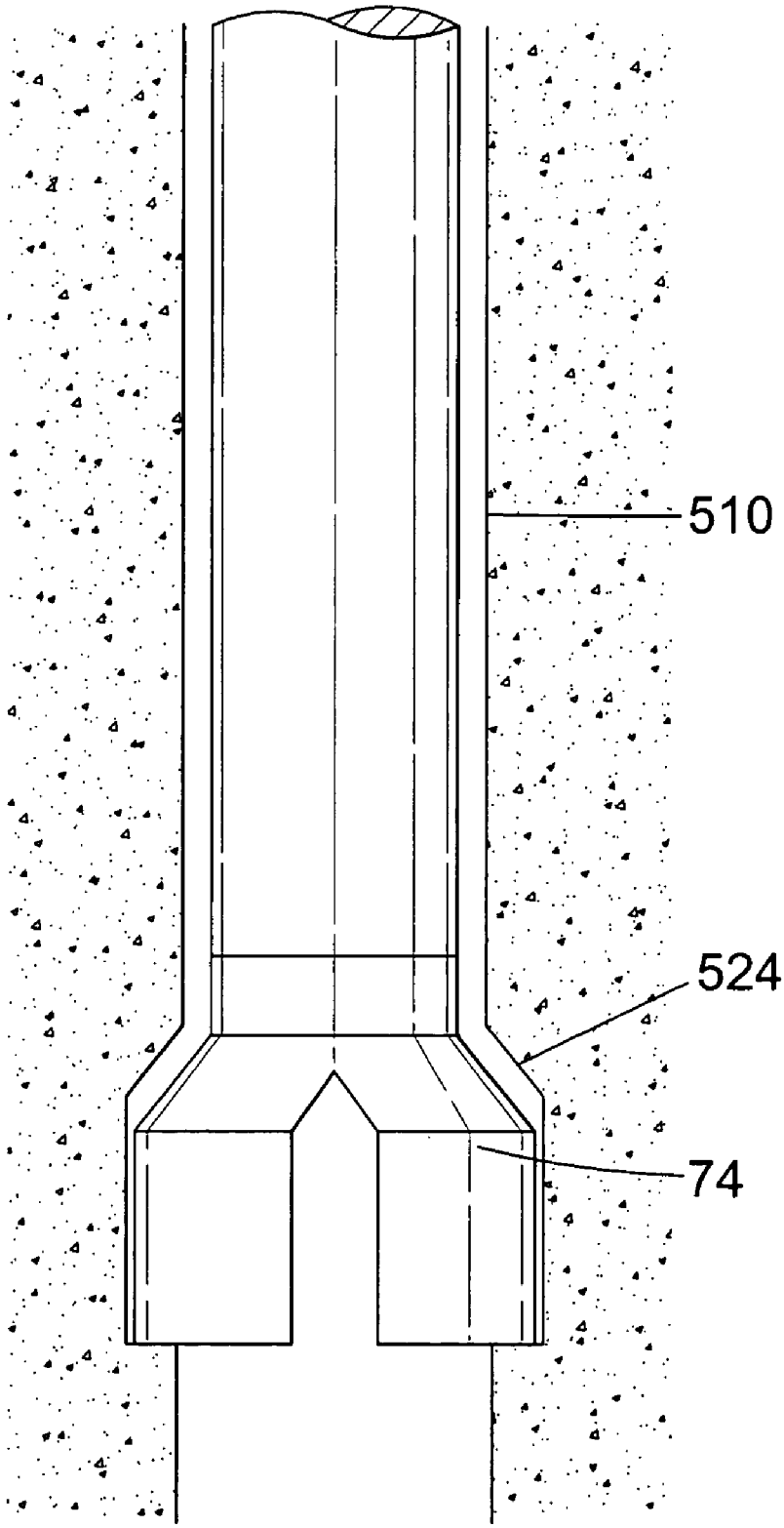

FIG. 23 illustrates steps in a method of forming a tubing lined borehole in accordance with a further alternative embodiment of the present invention. A borehole 510 is formed using a conventional drill bit and an underreamer tool 74 is subsequently run-in to form an underreamed section 524. The underreamer tool 74 is shown during underreaming of the section 524. Following completion of underreaming of the borehole along a desired length, the underreamer is pulled out of the hole and the borehole is then lined according to one of the methods described in relation to FIGS. 20 to 22. It will be understood that the underreamer tool 74 may be provided as part of a string including a drill bit, such that the section 524 may be underreamed concurrently or immediately following drilling of the borehole 510, or may be underreamed in separate tool runs. Indeed, the borehole 510 may be drilled and underreamed at 524 according to any suitable method.

Those of skill in the art will appreciate that the above described embodiments are merely exemplary of the present invention, and that various modifications and improvements may be made to the foregoing without departing from the scope of the present invention.

For example, the method may be used in situations where it is not required or desired to define a mono-bore cased borehole. Thus, for example, expandable casing 54 may not be expanded to match or exceed the internal diameter of the upper casing section 12. Only part of the casing 54 may therefore only be expanded; indeed, only the upper end 56 of the casing 54 may be expanded, for coupling to the casing 12, a remainder of the casing 54 remaining unexpanded. Accordingly, the end 20 of the casing 12 may not be expanded out to the degree shown in FIG. 9, which is required to form a mono-bore with the casing 54, and may therefore be expanded to a position intermediate the unexpanded position of FIG. 8 and the expanded position of FIG. 9.

Similarly, in the case of the expandable casing 154 of FIGS. 11 to 13, the portion of casing 154 below the coupling with the upper casing 12 may only be partially expanded or may remain unexpanded.

The second tubing may be expanded to an internal diameter greater than that of the first tubing at a level below the interface between the tubings.

The cutting tool may include any desired number of cutting elements at any suitable spacing. For example, the tool may include three cutting elements at 120° spacings. The cutting element may be of any suitable shape and may include any suitable number of cutting faces. The cutting element may include independently rotatable or moveable cutting members. The cutting element may be electronically, electrically, mechanically or electro-mechanically moveable. Alternatively, the cutting element may be moveable by rotation of the tool.

The cutting element may be independently axially moveable with respect to a body of the tool for movement to cut the annular gap.

The cutting element may serve for enlarging a length of the borehole to a larger bore diameter, as well as for cutting the required annular gap around tubing in the borehole. For example, the cutting element may enlarge the bore diameter during movement to the cutting position, and may then be used to cut the annular gap. This may facilitate cutting of the annular gap without requiring a separate tool to be run in; without providing a separate cutting tool coupled to the cutting tool of the invention; and without providing a separate cutting element as part of the cutting tool.

The invention claimed is:

1. A method of forming a tubing lined borehole, the method comprising:

forming a borehole;

locating bore-lining tubing in the borehole; and enlarging part of the borehole by cutting an annular gap around an outer surface of the bore-lining tubing thereby increasing the diameter of the borehole with at least part of the tubing located in the part of the borehole that is enlarged.

2. A method as claimed in claim 1, comprising locating a downhole cutting tool in an unlined portion of the borehole; rotating the cutting tool; and moving the cutting tool axially over the tubing to cut the annular gap.

3. A method as claimed in claim 2, comprising moving the cutting tool axially over an end of the tubing.

4. A method as claimed in claim 2, further comprising moving a cutting element of the cutting tool from a retracted position to a cutting position where the cutting element describes an enlarged diameter; rotating the cutting element; and moving the cutting element axially over the tubing.

5. A method as claimed in claim 1, comprising cementing the tubing before cutting the annular gap.

6. A method as claimed in claim 1, comprising locating bore-lining tubing including a section of tubing having a compressible material defining an annular sleeve around an outer surface thereof in the enlarged part of the borehole.

7. A tubing-lined borehole comprising:

a first borehole part;

a larger diameter second borehole part; and bore-lining tubing located in the borehole with at least part of the bore-lining tubing in the larger second borehole part, wherein a first portion of the bore-lining tubing is cemented in the first borehole part and an annular gap surrounds an outer surface of a second portion of the bore-lining tubing connected to the first portion and located in the larger second borehole part.

8. A tubing-lined borehole, comprising:

a first borehole part;

a larger diameter second borehole part; and bore-lining tubing located in the borehole with at least part of the bore-lining tubing in the larger second borehole part, wherein the bore-lining tubing is cemented in the borehole.

9. A tubing-lined borehole, comprising:

a first borehole part;

a larger diameter second borehole part; and bore-lining tubing located in the borehole with at least part of the bore-lining tubing in the larger second borehole part, including an annular gap around an outer surface of said part of the bore-lining tubing located in the larger second borehole part.

10. The tubing lined borehole of claim 9, wherein additional tubing overlaps at least a portion of the part of the bore-lining tubing located in the larger second borehole part.

11. The tubing lined borehole of claim 10, wherein the additional tubing is located at least partially inside the bore-lining tubing.

12. The tubing lined borehole of claim 10, wherein the additional tubing is located at least partially outside the bore-lining tubing.

13. A method of forming a tubing lined borehole, comprising:

providing a borehole;

locating bore-lining tubing in the borehole, the locating comprising:

enlarging part of the borehole by cutting an annular gap around an end of a first tubing located in the borehole thereby increasing the diameter of the borehole;

expanding the end of the first tubing to a larger diameter to provide an expanded end;

expanding a smaller diameter second tubing; and locating an end of the second tubing in the expanded end of the first tubing.

14. A method as claimed in claim 13, wherein the smaller diameter second tubing is located overlapping the end of the first tubing following expansion of the first tubing and before expansion of the second tubing.

15. A method as claimed in claim 13, wherein the second tubing is located in the end of the first tubing before expansion of the first tubing.

16. A method as claimed in claim 13, wherein the second tubing is expanded while located in an unlined portion of the borehole adjacent an end of the first tubing.

17. A method as claimed in claim 16, wherein the first tubing end is expanded to an internal diameter approximately equal to an external diameter of the expanded smaller second tubing.

18. A method as claimed in claim 17, wherein the expanded second tubing is subsequently located within the expanded end of the first tubing by moving the second tubing axially into engagement with the first tubing.

19. A method as claimed in claim 13, further comprising cementing the first tubing in the borehole.

20. A method as claimed in claim 13, wherein following location of the second tubing, an interface between the first and second tubings is cemented and at least part of an annulus between the second tubing and the borehole is also cemented.

21. A method as claimed in claim 13, wherein the second tubing is expanded to an internal diameter at least equal to an internal diameter of the first tubing.

22. A method as claimed in claim 13, wherein the second tubing is expanded at least partly to a greater internal diameter than the internal diameter of the first tubing.

23. A method as claimed in claim 13, wherein the second tubing is run into the first tubing and suspended from a string of support tubing extending to surface.

24. A method of forming a tubing lined borehole, comprising:

providing a borehole;

locating bore-lining tubing in the borehole, the locating comprising:

enlarging part of the borehole by cutting an annular gap around an end of a first tubing located in the borehole thereby increasing the diameter of the borehole;

locating a smaller diameter second tubing in an unlined portion of the borehole adjacent the end of the first tubing;

expanding the smaller diameter second tubing; and locating an end of the second tubing around the end of the first tubing.

25. A method as claimed in claim 24, wherein the second tubing is located around the end of the first tubing at least partly by frictional contact between the end of the second tubing and the end of the first tubing.

26. A method as claimed in claim 24, wherein at least an end of the second tubing is expanded to an internal diameter approximately equal to an external diameter of the first tubing.

27. A method as claimed in claim 24, further comprising cementing the first tubing in the borehole.

28. A method as claimed in claim 24, wherein following location of the second tubing, an interface between the first and second tubings is cemented and at least part of an annulus between the second tubing and the borehole is also cemented.

29. A method as claimed in claim 24, wherein the second tubing is expanded to an internal diameter at least equal to an internal diameter of the first tubing.

30. A method as claimed in claim 24, wherein the second tubing is expanded at least partly to a greater internal diameter than the internal diameter of the first tubing.

31. A method as claimed in claim 24, wherein the second tubing is run into the first tubing and suspended from a string of support tubing extending to surface.

32. A method of lining a borehole having bore-lining tubing disposed therein, comprising:

enlarging a part of the borehole by cutting an annular gap around an outer surface of the bore-lining tubing thereby increasing the diameter of the borehole; and locating additional tubing in the borehole with at least part of the additional tubing located in the part of the borehole that is enlarged.

33. A method as claimed in claim 32, further comprising:

locating a downhole cutting tool in an unlined portion of the borehole;

rotating the cutting tool; and moving the cutting tool axially over the bore-lining tubing to cut the annular gap.

34. A method as claimed in claim 32, wherein the bore-lining tubing is cemented in the borehole prior to cutting the annular gap.

35. The tubing lined borehole of claim 32, wherein the additional tubing is located at least partially inside the bore-lining tubing.

36. The tubing lined borehole of claim 32, wherein the additional tubing is located at least partially outside the bore-lining tubing.

37. The tubing lined borehole of claim 32, further comprising expanding at least part of the additional tubing.

38. The tubing lined borehole of claim 32, further comprising expanding at least part of the additional tubing and the bore-lining tubing.

* * * * *